US007900561B2

(12) United States Patent
Marx

(10) Patent No.: US 7,900,561 B2
(45) Date of Patent: Mar. 8, 2011

(54) REDUCED FRICTION PROJECTILE

(75) Inventor: PJ Marx, Sarasota, FL (US)

(73) Assignee: Liberty Ammunition, LLC, Clearwater, FL (US)

( * ) Notice: Subject to any disclaimer, the term of this patent is extended or adjusted under 35 U.S.C. 154(b) by 0 days.

(21) Appl. No.: 12/784,659

(22) Filed: May 21, 2010

(65) Prior Publication Data

US 2010/0224095 A1 Sep. 9, 2010

Related U.S. Application Data

(63) Continuation-in-part of application No. 11/255,261, filed on Oct. 21, 2005, now Pat. No. 7,748,325.

(60) Provisional application No. 61/326,809, filed on Apr. 22, 2010.

(51) Int. Cl.
*F42B 14/02* (2006.01)

(52) U.S. Cl. ..... 102/526; 102/525; 102/524; 102/517

(58) Field of Classification Search ..... 102/501, 102/503, 516, 517, 524, 525, 526
See application file for complete search history.

(56) References Cited

U.S. PATENT DOCUMENTS

| | | | | |
|---|---|---|---|---|
| 40,153 | A | 10/1863 | Billings | |
| 2,322,751 | A | 6/1943 | Studler | |
| 2,946,261 | A | 7/1960 | Crockett | |
| 3,348,486 | A | 10/1967 | Rapp | |
| 3,913,489 | A | 10/1975 | Travor et al. | |
| 3,952,657 | A | 4/1976 | Kaltmann | |
| 5,686,693 | A | 11/1997 | Jakobsson | |
| 6,305,293 | B1 * | 10/2001 | Fry et al. | 102/517 |
| 6,317,946 | B1 | 11/2001 | Beal | |
| 6,439,125 | B1 * | 8/2002 | Carter | 102/507 |
| 7,207,275 | B1 | 4/2007 | Oertwig | |
| 7,219,607 | B2 | 5/2007 | Oertwig | |
| 7,222,573 | B2 | 5/2007 | Pontieri | |
| 7,451,706 | B2 | 11/2008 | Meyer | |
| 7,748,325 | B2 * | 7/2010 | Marx | 102/517 |
| 2005/0183617 | A1 | 8/2005 | MacDougall | |
| 2006/0027128 | A1 | 2/2006 | Hober | |
| 2007/0089628 | A1 * | 4/2007 | Elder | 102/517 |
| 2007/0089629 | A1 | 4/2007 | Marx | |

* cited by examiner

*Primary Examiner* — James S Bergin
(74) *Attorney, Agent, or Firm* — Anton J. Hopen; Smith & Hopen, P.A.

(57) ABSTRACT

A projectile includes a leading part formed by a tip, a tip base, and a leading rod. A trailing part includes a main base, a truncate base, and a trailing rod. A leading end of a cylindrical interface abuts an annular shoulder where the tip meets the tip base and a trailing end abuts an annular shoulder where the main base meets the truncate base. The tip base and the truncate base respectively support the leading and trailing ends of the cylindrical interface. A medial extent of the cylindrical interface is unsupported by the leading and trailing rods and is deformed radially inwardly by lands in a barrel when the projectile is fired. The leading and trailing ends of the cylindrical interface maintain contact with the lands and the medial extent does not, reducing friction between the projectile and the barrel without sacrificing spin of the projectile.

6 Claims, 5 Drawing Sheets

REDUCED FRICTION PROJECTILE

CROSS-REFERENCE TO RELATED APPLICATIONS

This application is a continuation-in-part of and claims priority to pending U.S. patent application Ser. No. 11/255,261, entitled: "Firearms Projectile," filed Oct. 21, 2005 by the same inventor, which application is hereby incorporated by reference into this application. This application also claims priority to U.S. Provisional Patent Application No. 61/326,809, entitled "Reduced Friction Projectile," filed Apr. 22, 2010 by the same inventor, which application is hereby incorporated by reference into this application.

BACKGROUND OF THE INVENTION

1. Field of the Invention

This invention relates, generally, to the art of projectiles. More particularly, it relates to a projectile that is crimped at preselected locations along its length when fired.

2. Description of the Prior Art

Conventional projectiles engage the lands and grooves formed in a gun barrel along substantially the entire length of the projectile. About the only part of the projectile that does not engage the rifling is the ogive-shaped leading tip of the projectile.

The art has not recognized that the substantially full-length engagement of a projectile and rifling reduces the kinetic energy of the projectile. Nor has it recognized that the friction created by such substantially full-length engagement causes the barrel to heat up with repeated firing. Nor has the art recognized that such substantially full-length engagement leads to deformation of the projectile by the rifling in a way that is unpredictable. Such unpredictable deformation leads to unpredictable alterations in behavior of the projectile.

Thus there is a need for a projectile that has less contact with rifling vis a vis a conventional projectile so that the kinetic energy of the projectile can be increased.

There is a need as well for a projectile that has less contact with rifling to reduce friction-related heat build-up in a barrel caused by repeated firing without sacrificing spin imparted by the rifling.

There is also a need for a projectile that deforms in a predictable way when fired.

However, in view of the art considered as a whole at the time the present invention was made, it was not obvious to those of ordinary skill in the art how the identified needs could be met.

SUMMARY OF THE INVENTION

The long-standing but heretofore unfulfilled need for a projectile not subject to the limitations of prior art projectiles is now met by a new, useful, and non-obvious invention.

The novel projectile includes a leading part formed by a tip having a generally ogive shape. A tip base of cylindrical construction is formed integrally with the tip and has a reduced diameter relative to a trailing end of the tip so that a first annular shoulder is formed where the trailing end of the tip meets the leading end of the tip base. A leading rod is formed integrally with the tip base and has a reduced diameter relative to the diameter of the tip base so that a second annular shoulder is formed where a trailing end of the tip base meets the leading end of the leading rod.

The novel projectile further includes a trailing part formed by a main base. A truncate base of cylindrical construction is formed integrally with a leading end of the main base and has a reduced diameter relative to the diameter of the leading end of the main base so that a third annular shoulder is formed where the leading end of the main base meets the trailing end of the truncate base. A trailing rod is formed integrally with a leading end of the truncate base and has a reduced diameter relative to the diameter of the truncate base so that a fourth annular shoulder is formed where the truncate base meets the trailing rod.

A cylindrical interface has a leading end that abuttingly engages the first annular shoulder and a trailing end that abuttingly engages the third annular shoulder. The cylindrical interface has a leading extent supported by the extent of the tip base, a trailing end supported by the extent of the truncate base, and a medial extent unsupported by said leading rod and said trailing rod.

The unsupported medial extent of the cylindrical interface is therefore deformed radially inwardly by lands in a barrel when the projectile is fired. The leading and trailing ends of the cylindrical interface maintain contact with the lands and the medial extent does not, thereby reducing friction between the projectile and the barrel without sacrificing the spin of the projectile imparted by the lands and grooves.

The leading rod has a flat trailing end that abuts a flat leading end of the trailing rod when the leading end of the cylindrical interface abuts the first annular shoulder and the trailing end of the cylindrical interface abuts the third annular shoulder.

The leading rod and the trailing rod share a common cylindrical configuration so that the cylindrical interface conforms to such cylindrical configuration along the unsupported medial extent thereof when the medial extent is deformed by the lands and grooves.

In a second embodiment, a first plurality of radially outwardly projecting elongate ribs is formed in the leading rod in equidistantly and circumferentially spaced apart relation to one another and in parallel relation to a longitudinal axis of symmetry of the projectile. A second plurality of radially outwardly projecting elongate ribs is formed in the trailing rod in equidistantly and circumferentially spaced apart relation to one another and in parallel relation to the longitudinal axis of symmetry of the projectile.

The first and second plurality of elongate ribs are disposed in supporting relation to the cylindrical interface along its entire extent so that when the lands supply radially inwardly directed crushing forces, the cylindrical interface is deformed radially inwardly in unsupported valleys between said elongate ribs.

In a third embodiment, the leading rod and the trailing rod have a hexagonal cross-sectional configuration. When the lands supply radially inwardly directed crushing forces, the cylindrical interface is deformed radially inwardly until it conforms along its length to the hexagonal shape of the leading and trailing rods.

In a fourth embodiment, the leading rod and the trailing rod have a fluted cross-sectional configuration. When the lands supply radially inwardly directed crushing forces, the cylindrical interface is deformed radially inwardly until it conforms along its length to the fluted shape of the leading and trailing rods.

Thus it is understood that the respective cross-sectional configurations of the leading and trailing rods may be provided in any predetermined geometrical configuration and that the cylindrical interface will be deformed by the lands upon projectile firing so that the cylindrical interface conforms to the predetermined geometrical configuration of the leading and trailing rods. This advantageously reduces the frictional contact between the cylindrical interface and the rifling without affecting the contact between the leading and trailing parts of the projectile and the rifling. Thus, spin is still imparted to the projectile but the friction created by the travel of the projectile through the barrel is substantially reduced.

An important object of the invention is to reduce the friction between a projectile and the interior of a gun barrel to increase the kinetic energy of the projectile, to reduce heat build-up in the barrel caused by repeated rapid firing, and to deform the projectile in a predictable, consistent way.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
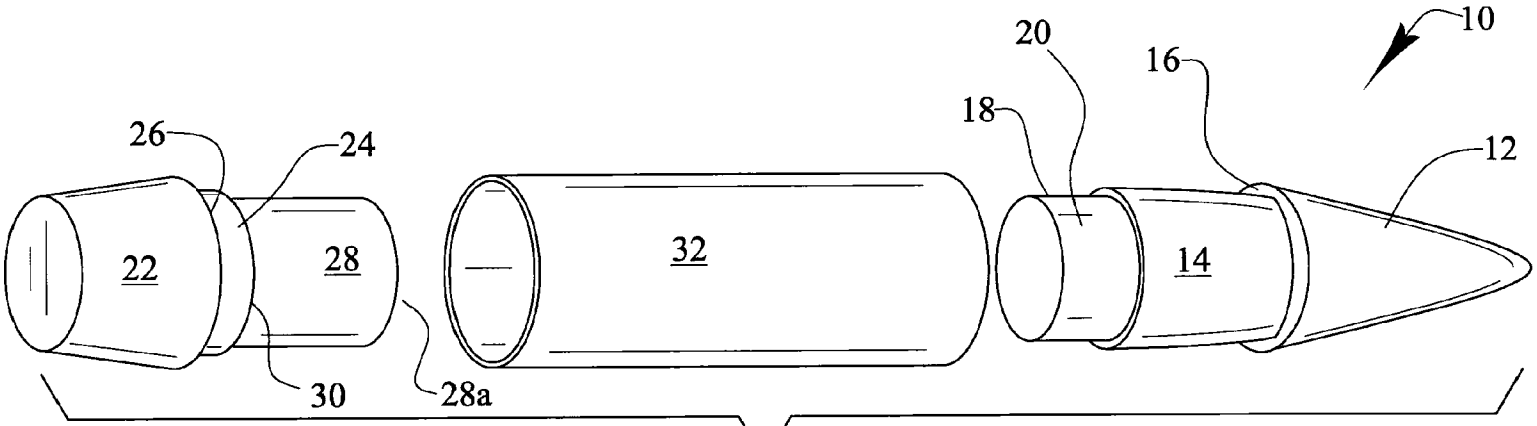
FIG. 1 is an exploded perspective view of a first embodiment of the invention including a leading part, a trailing part, and a cylindrical interface that interconnects the leading and trailing parts to one another.

Referring now to FIG. 1, it will there be seen that an exploded perspective view of the novel projectile is denoted as a whole by the reference numeral 10.

Projectile 10 includes a leading part formed by nose cone or tip 12 having a generally ogive shape. Tip base 14 of solid cylindrical construction is integrally formed with tip 12 and has a reduced diameter so that first annular shoulder 16 is formed where the trailing end of tip 12 meets the leading end of tip base 14. Leading rod 18 is integrally formed with tip base 14 and has a reduced diameter so that second annular shoulder 20 is formed where the trailing end of tip base 14 meets the leading end of leading rod 18.

Projectile 10 further includes a trailing part formed by frusto-conical main base 22. Truncate base 24 of solid cylindrical construction is integrally formed with frusto-conical main base 22 and has a reduced diameter relative to the leading end of said main base so that third annular shoulder 26 is formed where the leading end of frusto-conical main base 22 meets the trailing end of truncate base 24. Trailing rod 28 is formed integrally with a leading end of said truncate base and has a reduced diameter relative to said leading end of said main base so that fourth annular shoulder 30 is formed where the leading end of truncate base 24 meets the trailing end of trailing rod 28.

Cylindrical interface 32 includes leading end 32*a* that abuttingly engages first shoulder 16 and a trailing end that abuttingly engages third shoulder 26.

Figure 2:
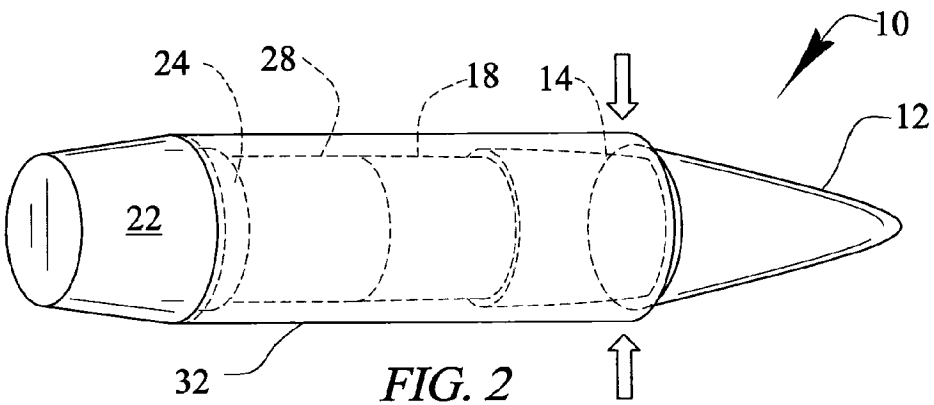
FIG. 2 is an assembled view of the parts depicted in FIG. 1 prior to crimping of the leading end of the cylindrical interface.
Figure 3:
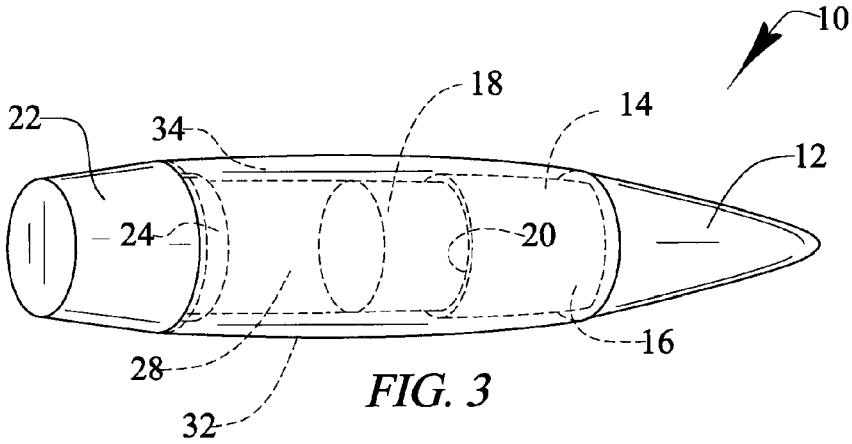
FIG. 3 is a perspective view of the embodiment of FIG. 1 after crimping of the leading end of the interface.

As indicated in FIG. 2 by the radially inwardly directed arrows, an annular crimp is formed at the leading end of cylindrical interface 32 to produce the finished construction depicted in FIG. 3 where the leading end of cylindrical interface 32 is substantially flush with the trailing end of tip 12. The internal diameter of cylindrical interface 32 is greater than the external diameter of the trailing end of tip 12 because cylindrical interface 32 ensleeves tip 12 as said cylindrical interface is introduced into its FIG. 2 position as indicated in FIG. 6D.

Figure 5:
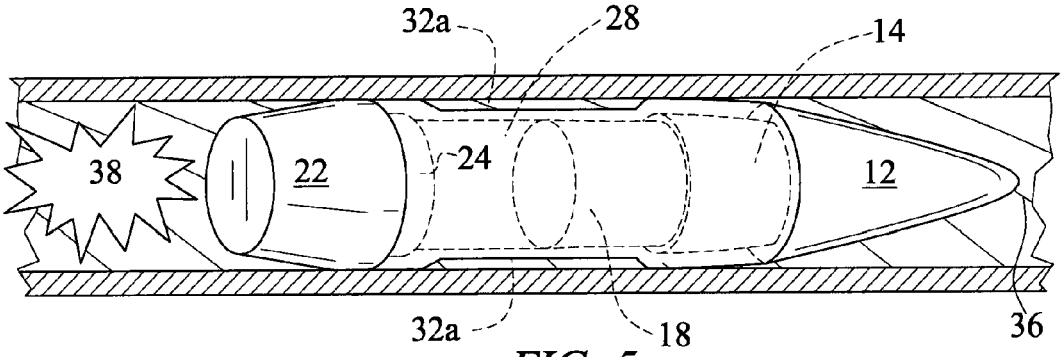
FIG. 5 is a perspective view like that of FIG. 5 but depicting an elongate crimp produced in the cylindrical interface as a result of firing the rifle.

The flat trailing end of leading rod 18 abuts the flat leading end of trailing rod 28 when the leading end of cylindrical interface 32 abuts first annular shoulder 16 and the trailing end of cylindrical interface 21 abuts third annular shoulder 26, as indicated in FIGS. 2, 3, and 5.

As depicted in FIGS. 2 and 3, cylindrical interstitial space 34 is defined radially inwardly of cylindrical interface 32 and radially outwardly of leading rod 18 and trailing rod 28. Accordingly, cylindrical interface 32 is supported at its leading extent by tip base 14 and at its trailing extent by truncate base 24. Therefore, cylindrical interface is unsupported along the extent thereof that is positioned radially outwardly of leading rod 18 and trailing rod 28. However, said leading rod 18 and said trailing rod 28 provide a limit beyond which cylindrical interface cannot be deformed if subjected to radially inwardly directed forces.

Figure 4:
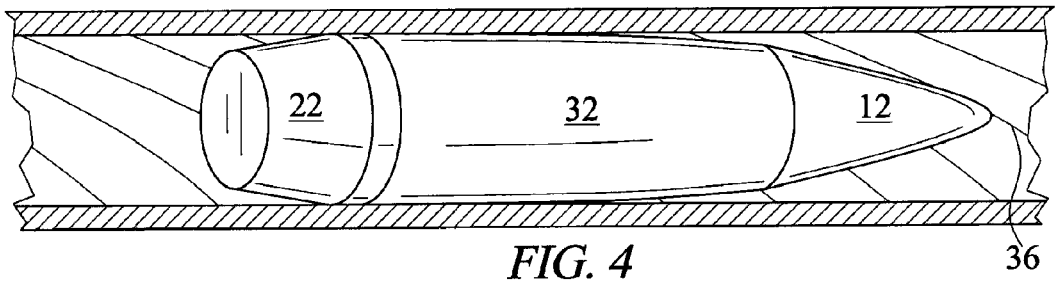
FIG. 4 is a perspective view of the first embodiment when positioned with a rifle barrel that is cut-away to enable viewing of the novel projectile.

FIG. 4 depicts novel projectile 10 when positioned in a rifle barrel. The rifling is denoted 36.

When projectile 10 is launched, as indicated by starburst 38 in FIG. 5, the radially inwardly projecting helical lands of rifling 36 exert a radially inwardly directed force on cylindrical interface 32 along its entire extent as it travels through the bore of the firearm. However, only the unsupported part of said cylindrical interface 32 is crushed by such forces as depicted in FIG. 5 and the extent of the crushing is limited by the presence of leading rod 18 and trailing rod 28 as aforesaid.

Advantageously, the leading extent of cylindrical interface 32 supported by tip base 14 and the trailing extent of cylindrical interface 32 supported by truncate base 24 are not displaced radially inwardly and thus retain contact with the lands so that spin is imparted to the projectile as desired. Also advantageously, the deformed or crushed extent of cylindrical interface 32 is disengaged from said lands, thereby substantially reducing friction between said cylindrical interface and the lands of the rifling. The reduced friction enables projectile 10 to escape from the barrel with increased velocity without sacrificing the beneficial aspects of the lands, i.e., without loss of spin.

Leading rod 18 and trailing rod 28 are depicted as being cylindrical in FIGS. 1 through 5. It should therefore be understood that the crushed or deformed extent of cylindrical interface 32 conforms to such cylindrical shape. As best understood in connection with FIGS. 6A-D, the invention is not limited to such cylindrical shape.

Figure 6A:
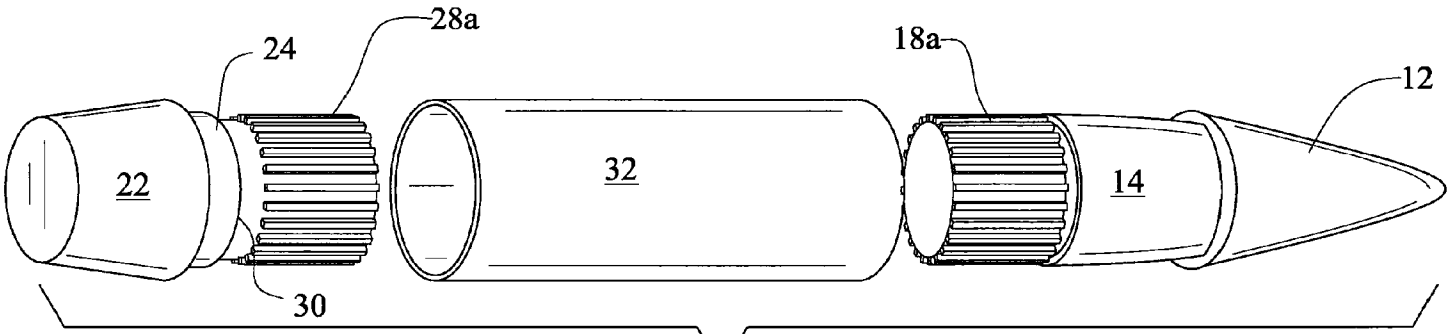
FIG. 6A is an exploded perspective view of a second embodiment.

In FIG. 6A, for example, a first plurality of radially outwardly projecting elongate ribs 18*a* are formed in trailing rod 18 in equidistantly and circumferentially spaced apart relation to one another and in parallel relation to a longitudinal axis of symmetry of projectile 10. A second plurality of radially outwardly projecting elongate ribs 28*a* are formed in trailing rod 28 in equidistantly and circumferentially spaced apart relation to one another and in parallel relation to a longitudinal axis of symmetry of projectile 10. These ribs support cylindrical interface 32 so that when the lands supply the radially inwardly directed crushing forces, only the elongate parts of cylindrical interface 32 between said ribs are unsupported and therefore deformed in a radially inward direction. This reduces the friction between projectile 10 and the interior of the barrel but it increases the surface area of cylindrical interface 32 that remains in contact with the spin-imparting lands vis a vis the surface area of the first embodiment.

Figure 6B:
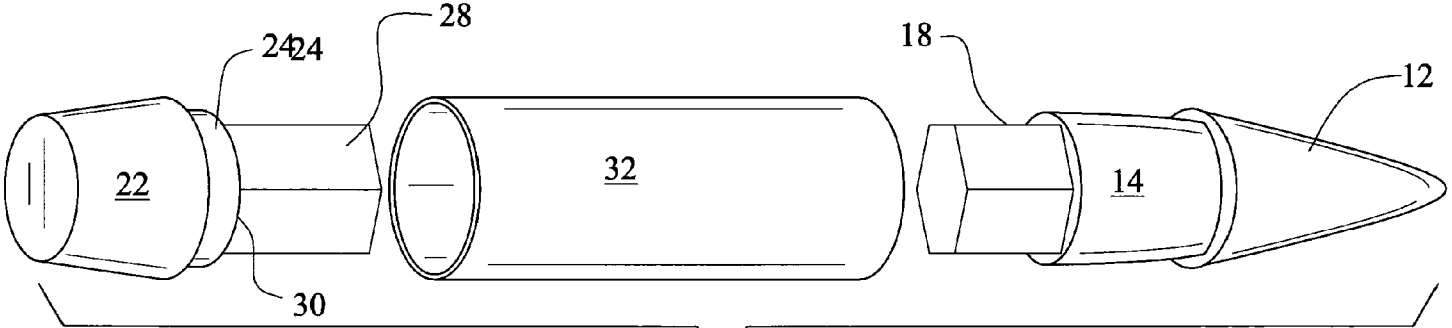
FIG. 6B is an exploded perspective view of a third embodiment.

Leading rod 18 and trailing rod 28 have a hexagonal configuration in the embodiment of FIG. 6B. The crushed or deformed section of cylindrical interface 32 will thus have a hexagonal shape as well. As in the embodiment of FIG. 6A, this reduces friction between projectile 10 and the interior of the barrel while maintaining contact at six (6) elongate linear extents with the spin-imparting lands. Leading rod 18 and trailing rod 28 may also have triangular, square, pentagonal and other predetermined geometrical cross-sectional configurations as well in order to both reduce friction while maintaining contact with the lands.

Figure 6C:
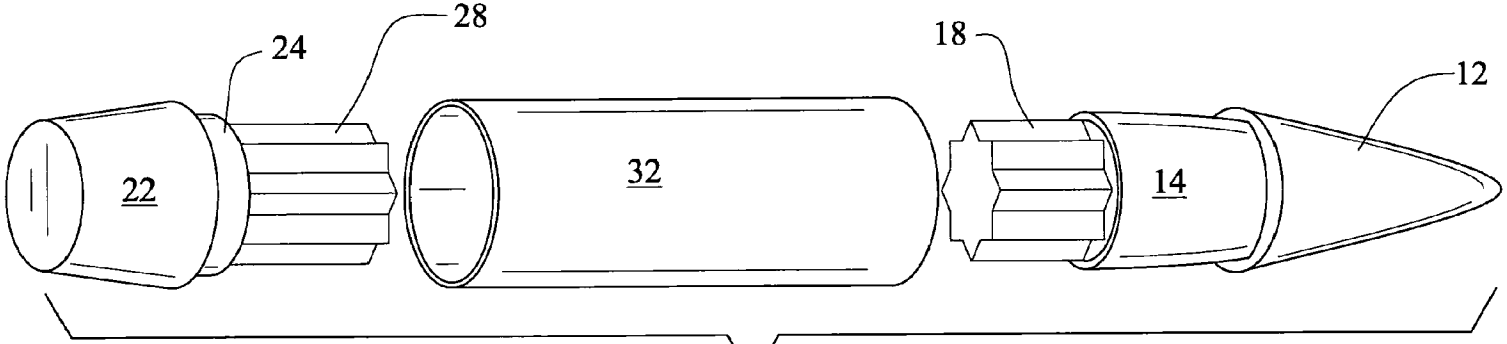
FIG. 6C is an exploded perspective view of a fourth embodiment.
Figure 6D:
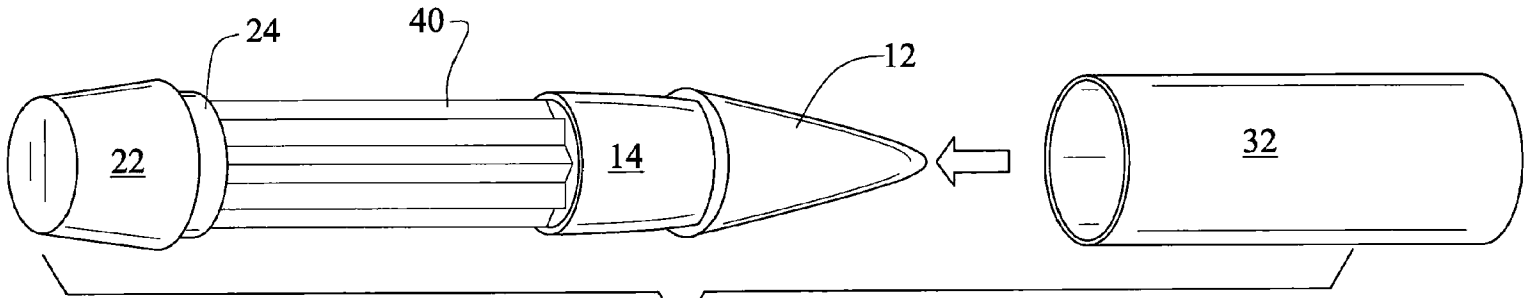
FIG. 6D is an exploded perspective view of a fifth embodiment.

A configuration having eight (8) contacts with linear extent is depicted in FIG. 6C.

In the embodiment of FIG. 6D, leading rod 18 and trailing rod 28 are integrally formed with one another to form resulting rod 40. Rod 40 is fluted like the embodiment of FIG. 6C and therefore has eight (8) contacts with linear extent. In all other respects, it provides the same benefits as the other embodiments.

The projectile of FIG. 6D is easy to manufacture. Cylindrical interface 32 is slid over tip 12 into position as indicated by the single-headed directional arrow and the leading end of said cylindrical interface 32 is then crimped as mentioned above in connection with FIG. 1.

Figure 7A:
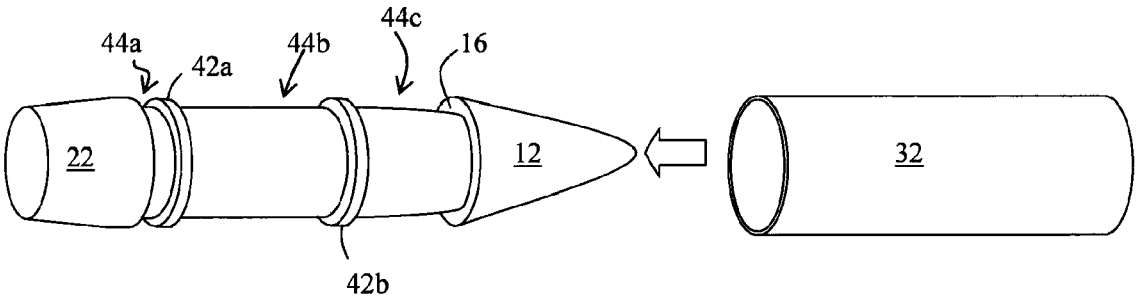
FIGS. 7A-7C are views of a sixth embodiment of the invention.
Figure 7B:
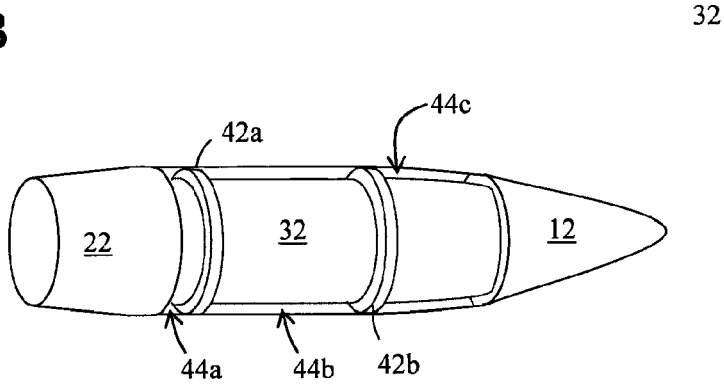
Figure 7C:
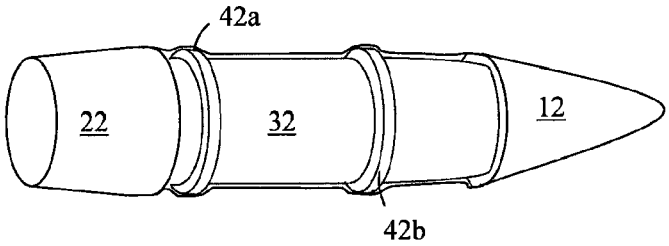

In yet another alternative embodiment shown in FIGS. 7A-C, rear annular shoulder 42*a* is formed forward of base 22 leaving first interstitial gap 44*a*. Forward annular shoulder 42*b* is formed forward of rear annular shoulder 42*a* and aft of tip 12 forming second interstitial gap 44*b* between forward annular shoulder 42*b* and rear annular shoulder 42*a*. A third interstitial gap 44*c* is formed between forward annular shoulder 42*b* and tip 12. While annular shoulders 42*a-b* are a preferred embodiment, it is within the scope of the invention that additional annular shoulders may be formed. FIG. 7B shows cylindrical interface 32 slide over projective an crimped about tip 12. Interstitial gaps 44*a-c* are noted. FIG. 7C shows cylindrical interface 32 compressed by the force of the propellant within the barrel (not shown) to follow the contours of annular shoulders 42*a-b*. It should be noted that the height of annular should 42*a-b* and interstitial gaps 44*a-c* are not necessarily drawn to scale but to be illustrative of the inventive concept. It should also be noted that FIGS. 7A-C show a unitary projectile but it is within the scope of the invention to employ annular shoulders 42*a-b* for a multi-component projectile as well as illustrated in FIGS. 1-5 and 6A-C.

It should be noted that a preferred dimension for the interstitial space (the gap measured radially) is computed by the difference between the diameter of the rifling grooves and the rifling lands minus approximately one one-thousandth of an inch. The difference between the diameter of the rifling grooves and the rifling lands is indicative of the compressive reduction of projectile diameter. However, the interstitial space should be somewhat less than this value (hence one one-thousandth of an inch) to ensure that the interface continues to engage the rifling of the barrel so that spin is still imparted on the projectile. The value of one one-thousandth of an inch may be varied wherein a greater value may ensure more engagement with the rifling but would also impart more friction and wear. Lesser values may reduce friction and wear on the barrel but could ultimately sacrifice flight-stabilizing spin.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A projectile, comprising:

a leading part formed by a tip having a generally ogive shape;

a tip base of cylindrical construction having a reduced diameter relative to a trailing end of said tip so that a first annular shoulder is formed where said trailing end of said tip meets a leading end of said tip base;

a leading rod formed integrally with said tip base and having a reduced diameter relative to said tip base so that a second annular shoulder is formed where a trailing end of said tip base meets a leading end of said leading rod;

a trailing part formed by a main base;

a truncate base of cylindrical construction formed integrally with a leading end of said main base and having a reduced diameter relative to said leading end of said main base so that a third annular shoulder is formed where said leading end of main base meets said trailing end of said truncate base;

a trailing rod formed integrally with a leading end of said truncate base and having a reduced diameter relative to said truncate base so that a fourth annular shoulder is formed where said leading end of said truncate base meets said trailing end of said trailing rod;

a cylindrical interface including a leading end that abuttingly engages said first annular shoulder and a trailing end that abuttingly engages said third annular shoulder;

said leading end of said cylindrical interface supported by said tip base and said trailing end of said cylindrical interface supported by said truncate base;

a medial extent of said cylindrical interface between said leading end and said trailing end being unsupported by said leading rod and said trailing rod;

said medial extent being deformed radially inwardly by lands in a barrel when said projectile is fired from said barrel;

whereby the leading and trailing ends of said cylindrical interface maintain contact with said lands and said medial extent does not, thereby reducing friction between said projectile and said barrel without sacrificing spin of said projectile.

2. The projectile of claim 1, further comprising:

said leading rod having a flat trailing end that abuts a flat leading end of said trailing rod when the leading end of said cylindrical interface abuts said first annular shoulder and the trailing end of said cylindrical interface abuts said third annular shoulder.

3. The projectile of claim 2, further comprising:

said leading rod and said trailing rod having a cylindrical configuration so that said cylindrical interface conforms to such cylindrical configuration along said medial extent thereof when said medial extent is deformed by said lands.

4. The projectile of claim 2, further comprising:

a first plurality of radially outwardly projecting elongate ribs formed in said leading rod in equidistantly and circumferentially spaced apart relation to one another and in parallel relation to a longitudinal axis of symmetry of said projectile;

a second plurality of radially outwardly projecting elongate ribs formed in said trailing rod in equidistantly and circumferentially spaced apart relation to one another and in parallel relation to a longitudinal axis of symmetry of said projectile;

said first and second plurality of elongate ribs disposed in supporting relation to said cylindrical interface so that when the lands supply radially inwardly directed forces, only circumferentially spaced apart elongate parts of said cylindrical interface between said first and second plurality of elongate ribs are unsupported and therefore deformed in a radially inward direction.

5. The projectile of claim 2, further comprising:

said leading rod and said trailing rod having a hexagonal cross-sectional configuration so that said medial extent of said cylindrical interface conforms to said hexagonal shape when said medial extent is deformed by said lands.

6. The projectile of claim 2, further comprising:

said leading rod and said trailing rod having a cross-sectional configuration of predetermined geometric configuration so that said medial extent of said cylindrical interface conforms to said predetermined geometric configuration when said medial extent is deformed by said lands.

* * * * *